United States Patent [19]

Iten

[11] Patent Number: 4,858,323

[45] Date of Patent: Aug. 22, 1989

[54] INTEGRALLY BACKED SINGLE-EDGE RAZOR BLADE

[75] Inventor: Clemens A. Iten, Fisherville, Va.

[73] Assignee: American Safety Razor Company, Verona, Va.

[21] Appl. No.: 108,628

[22] Filed: Oct. 15, 1987

[51] Int. Cl.[4] ..... B26B 21/54

[52] U.S. Cl. ..... 30/346.6; 30/346.5

[58] Field of Search ..... 30/346.5, 346.6, 346.61, 30/348, 355, 346, 356, 331, 346.56

[56] References Cited

U.S. PATENT DOCUMENTS

| | | | |
|---|---|---|---|
| 949,584 | 2/1910 | Levalley | 30/346.6 X |
| 1,895,763 | 1/1933 | Lubbertsmeier | 30/346.6 |
| 2,019,122 | 10/1939 | Doritza | 30/346.6 X |
| 2,108,267 | 2/1938 | O'Neill | 30/346.6 X |
| 2,674,034 | 4/1954 | DeMesquita | 30/346.61 X |

FOREIGN PATENT DOCUMENTS

| | | | |
|---|---|---|---|
| 348577 | 2/1922 | Fed. Rep. of Germany | 30/346.6 |

*Primary Examiner*—Douglas D. Watts
*Attorney, Agent, or Firm*—Nixon & Vanderhye

[57] ABSTRACT

An integrally backed single-edge razor blade has a plurality of projections struck from a margin of the blade remote from its cutting edge. The struck portions reinforce the blade and afford a blade edge remote from the cutting edge having a thickness greater than the thickness of the material forming the body of the blade. The blade may be formed by passing stock blade material through opposed dies for forming the projections as well as the conventional perforations through the blade.

12 Claims, 5 Drawing Sheets

FIG. 1
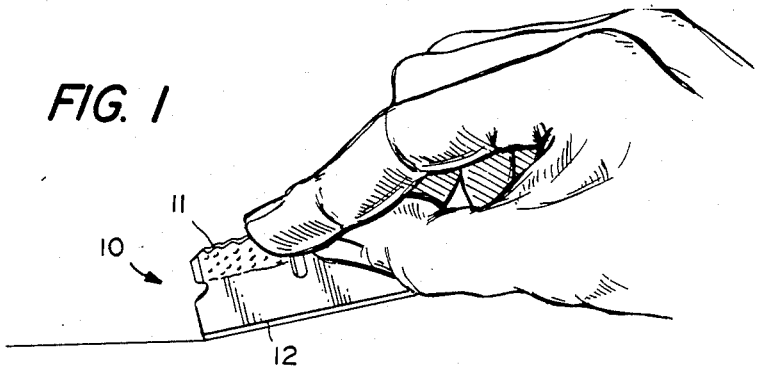
FIG. 2
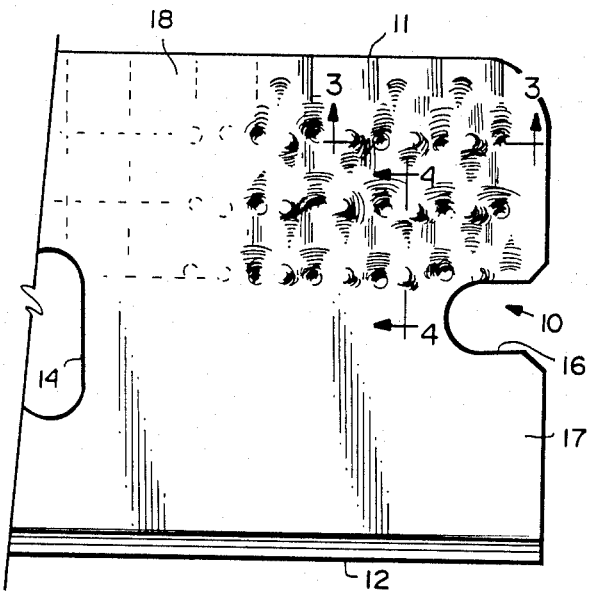
FIG. 16
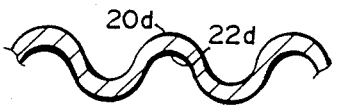
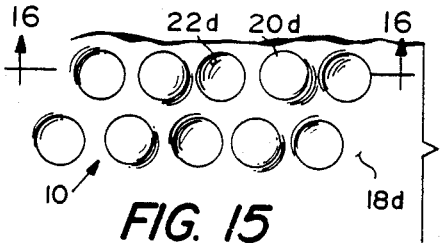
FIG. 15
FIG. 3
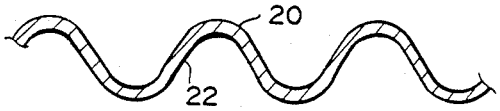
FIG. 4
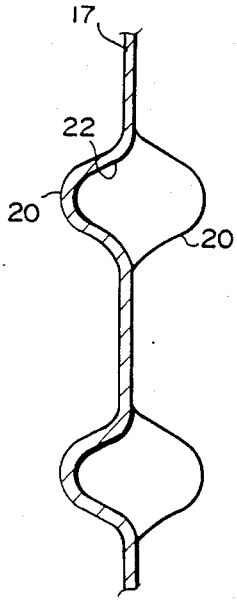

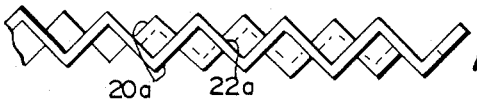
FIG. 6
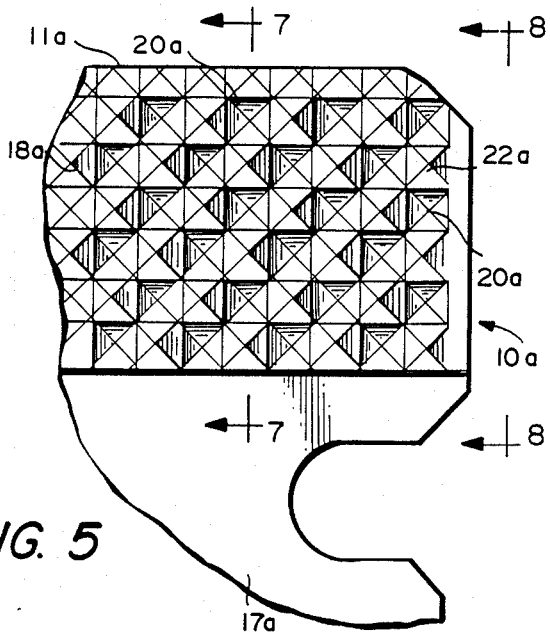
FIG. 5
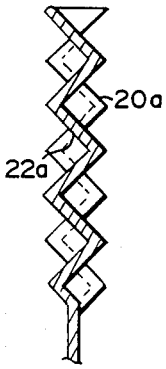
FIG. 7
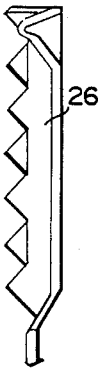
FIG. 8
FIG. 10
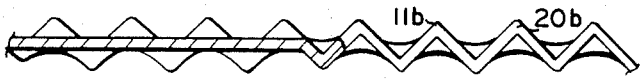
FIG. 11
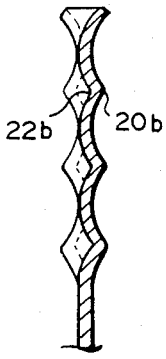
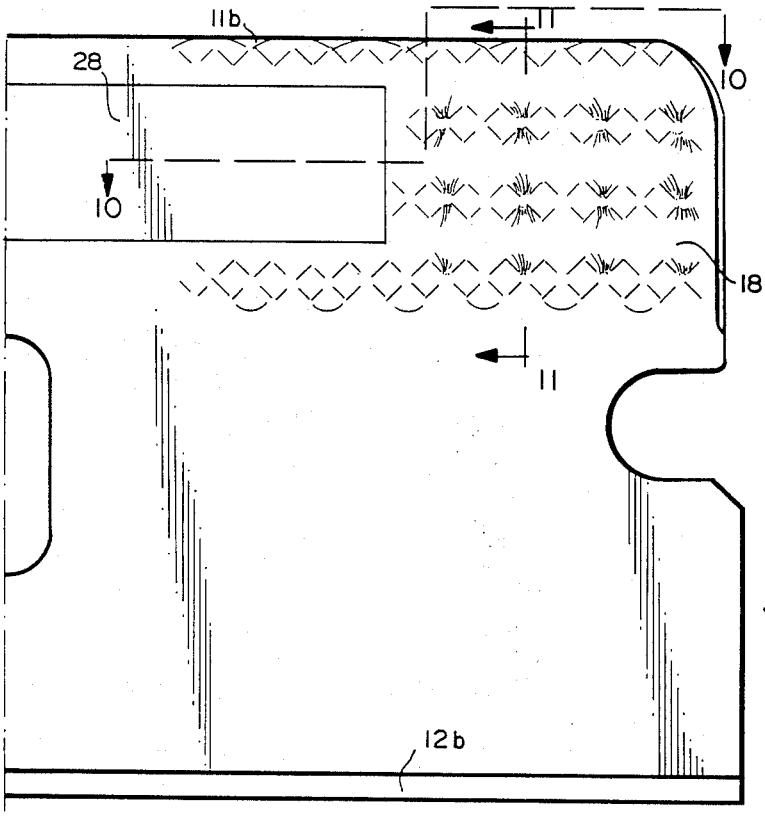
FIG. 9

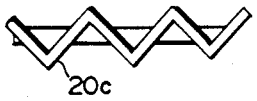
FIG. 13
FIG. 12
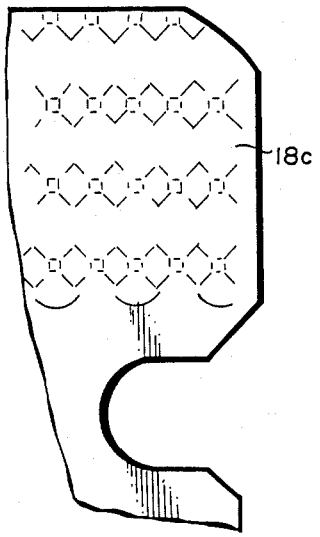
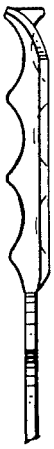
FIG. 14
FIG. 18
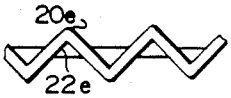
FIG. 17
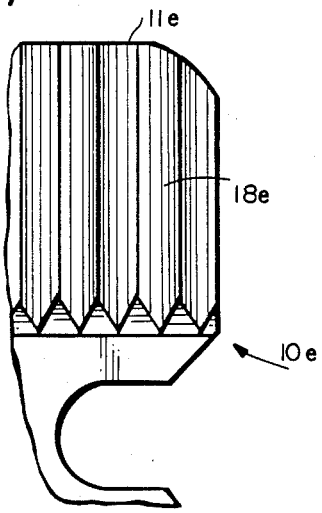
FIG. 19
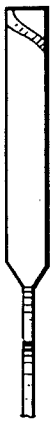

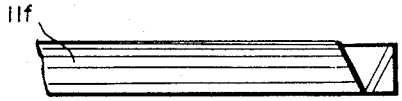
FIG. 21
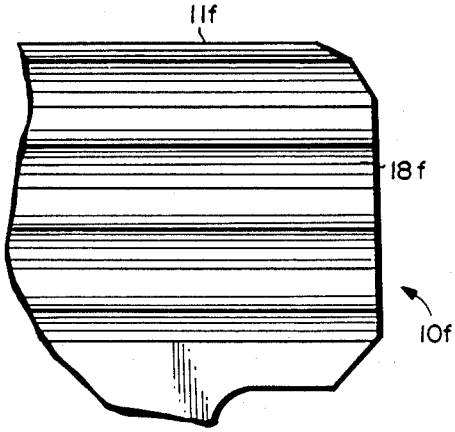
FIG. 20
FIG. 22
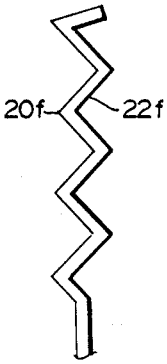
FIG. 24
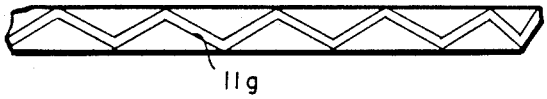
FIG. 25
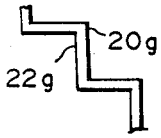
FIG. 23
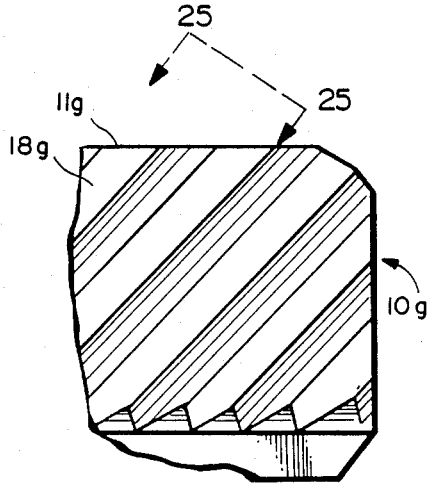
FIG. 26
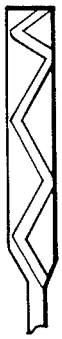

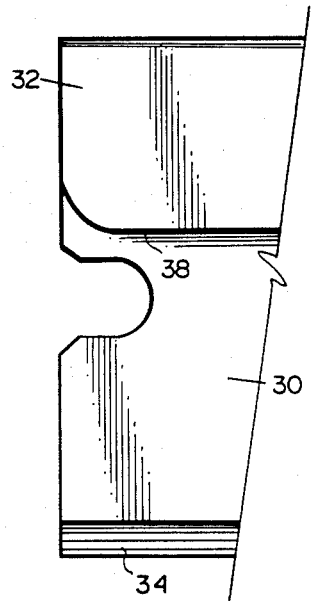
FIG. 27
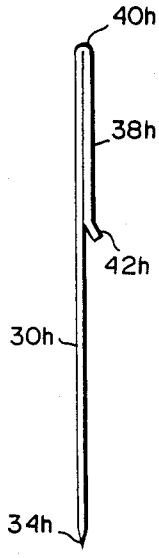
FIG. 28
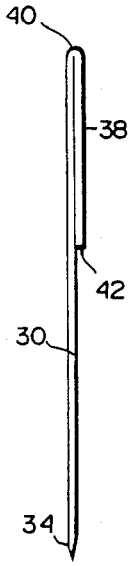
FIG. 29
FIG. 30
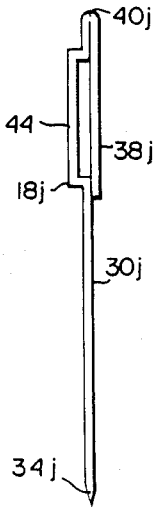
FIG. 31
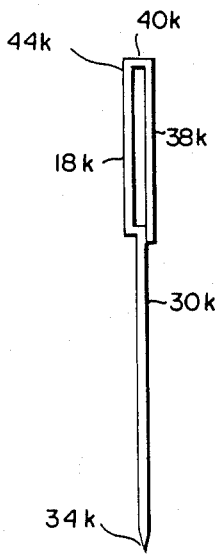
FIG. 32
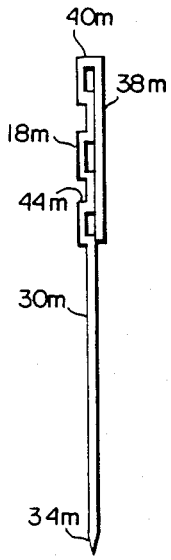

INTEGRALLY BACKED SINGLE-EDGE RAZOR BLADE

BACKGROUND AND SUMMARY OF THE INVENTION

The present invention relates to a single-edge razor blade and particularly relates to an integral one-piece single-edge razor blade having a back integrally formed from the blade material and a method of making the blade.

Single-edge razor blades are commonly used in a wide variety of environments. For example, such single-edge blades are commonly applied to a blade holder and used as a scraper. These blades are also used for cutting wherein the blade is held between an individual's fingers with the index finger bearing against the edge of the blade at a location remote from the cutting edge for purposes of applying pressure to the cutting edge. A multitude of different and other uses will occur to those acquainted with single-edge razor blades.

Conventionally, the common single-edge razor blade is formed of two parts: a first part comprising a flat strip of blade forming material, preferably steel, which is perforated, hardened, ground or otherwise sharpened along one edge to form a cutting blade and, secondly, a cap which is formed to overlie the edge of the blade remote from its cutting edge and applied to the blade. These blades are conventionally formed from a coil of material, e.g., steel, in strip form, which is then perforated and cut into the required shape, hardened, ground and then separated into individual blades. The cap is then formed and applied to the edge of the blade remote from its sharpened edge and the completed blade is then packaged. Such blade construction has been widely adopted and found eminently suitable for the purposes intended.

It will be appreciated, however, that the conventional single-edge razor blade has been formed in two parts, which necessitates separate handling of the discrete parts, as well as special operations on each part and the joining of the parts one to the other. In short, there is of necessity in the manufacturing process a separate and discrete cap forming and assembly step whereby the cap may be located on the blade remote from its cutting edge. While the single-edge razor blade of this conventional construction is per se of relatively modest cost, a substantial portion of that cost is incurred in the formation and application of the cap to the razor blade.

According to the present invention, there is provided an integral one-piece single-edge razor blade which eliminates the steps of forming and applying a separate cap piece to a razor blade and hence eliminates the costs associated with those steps. The present invention therefore provides a single-edge razor blade which is integrally backed and formed of the same material as the blade. Moreover, these savings in material and manufacturing costs are achieved without sacrificing the known conventional features of a single edged razor blade which may be used either in conjunction with a razor blade holder or individually by grasping the blade between the thumb and middle finger, using the index finger for manual purchase on the edge of the blade opposite its cutting edge. Thus, the functions associated with conventional single-edge razor blades are retained while the material and manufacturing costs are substantially reduced.

To accomplish this, the integral one-piece single-edge razor blade according to the present invention may be formed by striking or embossing a marginal portion of the blade remote from the blade cutting edge to reinforce the blade. Preferably, the marginal portion lies adjacent to and forms a part of the edge of the blade opposite the cutting edge. By striking or embossing the marginal portion, portions of the blade are projected out of the plane of the blade to form a series of projections or corrugations which reinforce the blade. Those projections or corrugations also extend along the edge of the blade remote from its cutting edge to enable an individual to obtain manual purchase along that edge when the blade hereof is used in a conventional manner for manual cutting. Thus, these projections or corrugations prevent injury to the the individual's index finger and the struck or embossed marginal portions provide strength to and reinforce the blade such that pressure may be applied from the back edge to the cutting edge without danger of collapse of the blade.

In manufacturing the blade hereof, when the strip of blade material is taken from the roll, the dies which perforate and form the blade also have die faces for striking or embossing the marginal portion of the blade. Thus, the conventional manufacture of a single-edge razor blade is modified to incorporate die faces for striking and embossing the blade simultaneously with its perforation and formation. The blade may thereafter be hardened, ground and separated from the strip into individual blades and subsequently packaged.

In accordance with a preferred form of the present invention, there is provided an integral one-piece single-edge razor blade comprising a thin, elongated blade body lying in a plane and having opposite, generally parallel, edges, one of the edges being sharpened to form a cutting edge, and a marginal portion of the blade body adjacent the opposite edge having portions struck from the body to project out of the plane at least to one side of the body to reinforce the marginal portion.

In another aspect of the present invention, there is provided an integral one-piece single-edge razor blade comprising a thin, elongated blade body lying in a plane and having opposite, generally parallel edges, one of the edges being sharpened to form a cutting edge. A portion of the blade body spaced from the cutting edge is struck to project out of the plane at least to one side of the body to reinforce the body. The edge of the struck portion of the blade being formed with portions lying to one side of the plane to facilitate manual purchase of the blade along such edge.

Accordingly, it is a primary object of the present invention to provide a novel and improved integral one-piece integrally backed single-edge razor blade.

These and further objects and advantages of the present invention will become more apparent upon reference to the following specification, appended claims and drawings.

BRIEF DESCRIPTION OF THE DRAWING FIGURES

FIG. 1 is a perspective view of an integrally backed single-edge razor blade constructed in accordance with the present invention and illustrated in use effecting a manual cutting action;

FIG. 2 is an enlarged fragmentary side elevational view of the razor blade of FIG. 1;

FIGS. 3 and 4 are cross-sectional views of the razor blade illustrated in FIG. 2 taken generally about on lines 3—3 and 4—4 thereof, respectively;

FIG. 5 is a view similar to FIG. 2 illustrating another form of a razor blade constructed in accordance with the present invention;

FIG. 6 is a partial plan view of the blade illustrated in FIG. 5;

FIGS. 7 and 8 are cross-sectional views of the blade illustrated in FIG. 5 taken generally about on lines 7—7 and 8—8 thereof, respectively;

FIG. 9 is a view similar to FIG. 5 illustrating a further form of razor blade constructed in accordance with the present invention;

FIG. 10 is a partial plan and cross-sectional view of the blade illustrated in FIG. 9 taken about on line 10—10 in FIG. 9;

FIG. 11 is a cross-sectional view of the blade illustrated in FIG. 9 taken generally about on line 11—11 in FIG. 9;

FIG. 12 is a view similar to FIG. 9 illustrating a still further form of razor blade constructed in accordance with the present invention;

FIG. 13 is a partial plan view of the blade illustrated in FIG. 12;

FIG. 14 is a partial end elevational view of the blade illustrated in FIG. 12;

FIG. 15 is a view similar to FIG. 12 illustrating yet another form of razor blade constructed in accordance with the present invention;

FIG. 16 is a fragmentary enlarged cross-sectional view thereof taken generally about on line 16—16 in FIG. 15;

FIG. 17 is a view similar to FIG. 12 illustrating yet another form of razor blade constructed in accordance with the present invention;

FIG. 18 is a partial plan view thereof;

FIG. 19 is a partial end elevational view of the blade illustrated in FIG. 17;

FIG. 20 is a partial side elevational view similar to FIG. 17 illustrating a still further form of razor blade constructed in accordance with the present invention;

FIG. 21 is a partial plan view of the blade illustrated in FIG. 20;

FIG. 22 is a partial end elevational view of the blade illustrated in FIG. 20;

FIG. 23 is a view similar to FIG. 20 illustrating a still further form of razor blade constructed in accordance with the present invention;

FIG. 24 is a partial plan view of the blade illustrated in FIG. 23;

FIG. 25 is a cross-sectional view thereof taken generally about on line 25—25 in FIG. 23;

FIG. 26 is a partial end elevational view of the blade illustrated in FIG. 23;

FIG. 27 is a partial elevational view of still another form of razor blade constructed in accordance with the present invention; and FIGS. 28 through 32 are end elevational views of various forms of integrally backed single-edge razor blades constructed in accordance with the present invention.

DETAILED DESCRIPTION OF THE DRAWING FIGURES

Reference will now be made in detail to the present preferred embodiment of the invention, an example of which is illustrated in the accompanying drawings.

Referring now to FIG. 1, there is illustrated an integral one-piece single-edge razor blade constructed in accordance with the present invention and generally designated 10. Blade 10 is illustrated in use manually cutting a material by an individual who is grasping the blade between his thumb and middle finger, with his index finger on the back edge 11 of the blade opposite the cutting edge 12.

Referring to FIG. 2, blade 10 is formed of a strip of stock metal material, for example coiled steel, with the standard aperture 14 being formed through the body, as well as end apertures 16. It will be appreciated that the body 17 of the razor blade is formed unitarily of a single piece of stock material and is strengthened along a marginal portion 18 thereof adjacent the edge of the blade opposite cutting edge 12.

Marginal portion 18 includes a series of projections 20 which project from opposite sides of the blade and are arranged in both longitudinal and transverse rows. The term "transverse" is used herein to indicate a direction normal to and extending between the cutting edge 12 and back edge 11. The projections 20 on one side form indentations 22 on the opposite side. As illustrated in FIG. 3, the projections and indentations 20 and 22, respectively, form a series of corrugations in the metal of the body when viewed along the long edge thereof transverse to the length of blade 10. The perforations extend to the back edge 11 of blade 10 opposite the cutting edge 12 and provide substantial width along that back edge to permit manual purchase by an individual's index finger, as illustrated in FIG. 1, for purposes of applying pressure to the blade for cutting.

The rows of projections in the longitudinal direction are aligned one with the other on opposite sides of the blade, as illustrated in FIG. 4. The projections in each longitudinal row alternate between opposite sides of the blade body 17. Thus, the formation of the projections 20 to opposite sides of the marginal portion 18 of the blade reinforces the blade in its transverse direction and enables manual purchase of the blade along the blade edge remote from cutting edge 12. The marginal portion 18 carrying the projections 20 extends from the edge 11 toward the cutting edge a distance less than one-half the transverse width of the blade, leaving the remaining unstruck or unembossed portion of the blade body smooth and wholly within blade 10.

To form the blade hereof, the stock material from which the razor blade 10 is formed comprises a coil of steel slit to the appropriate dimension. The stock material is then disposed between die faces, not shown, which perforate the strip and strike or emboss the projections 20 from the blade. Once the die faces have formed projections 22 in margin 18, the strip of razor blades is hardened and ground to form the cutting edge 12. The blades are then separated from the strip into individual blades and packaged.

Referring now to the embodiment hereof illustrated in FIGS. 5–8, there is provided as in the previous embodiment an integral one-piece single-edge razor blade, generally designated 10*a*. Blade 10*a* has a body 17*a* formed unitarily of a single piece of stock material, for example, coiled steel, and, as in the previous embodiment, is strengthened along a marginal portion 18*a* adjacent the back edge 11*a* thereof. More particularly, marginal portion 18*a* includes a series of generally pyramidal-shaped projections 20*a*, which project from opposite sides of the blade and are arranged in longitudinal and transversely extending rows. The projections 20*a* on one side form indentations 22a on the opposite side. In this form, each projection 20a and indentation 22a is in the form of a well-defined pyramid. The pyramids in each of the longitudinal and transverse rows, as viewed from one side of the blade, alternate with the indentations 22a on the same side of the blade. Additionally, the pyramids in each adjacent longitudinally extending row thereof on each side of the blade are longitudinally offset one from the other preferably a full pyramid width. Likewise, the pyramids in each adjacent transversely extending row thereof on each side of the blade are transversely offset one from the other preferably a full pyramid width.

The alternating indentations and projections extend along the back edge 11a as illustrated in FIG. 6 to provide a blade edge of substantial width, enabling manual purchase by an individual's index finger. Along the end edge of the blade 10a, there is provided a flange 26. It will be appreciated that, in this embodiment, the pyramids of the die faces by which the marginal portion 18 is formed penetrate upon closing of the die the medial plane of the razor blade, that is, the plane containing the body 17a of the blade.

Referring now to the embodiment hereof illustrated in FIGS. 9–11, there is illustrated a further form of integral one-piece single-edge razor blade constructed in accordance with the present invention, generally designated 10b. Blade 10b has a marginal portion 18b which is struck or embossed to form a plurality of projections 20b and indentations 22b along opposite sides thereof. Particularly, the projections 20b are aligned one with the other in both longitudinal and transverse rows. In this form, however, the projections 20b and indentations 22b in each row thereof, in either transverse and longitudinal directions, are aligned one with the other. That is, the projections in each longitudinal row and on each side of the blade are not offset from adjacent longitudinal rows as in the previous embodiment. Rather, they are aligned one with the other in longitudinal as well as transverse directions. Likewise, the projections 20b in each transverse row and on each side of the blade are not offset from adjacent transverse rows as in the previous embodiment. Rather, they likewise are aligned one with the other in transverse as well as longitudinal directions. Additionally, the projections 22b are not true pyramids in shape but rather have arcuate portions extending therebetween.

In this form, a flat 28 is formed intermediate the longitudinal and transverse extent of marginal portion 18b. Indicia may be placed on flat 28 either by embossment or by later-applied lettering. It will be appreciated from a review of FIG. 10, however, that the marginal back edge 11b has its corrugated shape extending the full length of blade 10b whereby manual purchase is assured throughout the full length of the blade. Note also that the indentations and projections 22b and 20b, respectively, extend along the blade between the flat 28 and the unembossed or unstruck portions of the blade between cutting edge 12b and marginal portion 18b, thereby affording adequate strength to the blade in the transverse direction including the area of flat 28.

The embodiment hereof disclosed in FIGS. 12–14 is similar to the embodiment disclosed in FIGS. 9–11. Here, however, and as best illustrated in FIG. 13, the portions of margin 18c between the rows of projections 20c extending in the longitudinal direction have linearly extending portions of margin 18b between projections 20c rather than arcuate sections, as illustrated in FIG. 10.

Referring now to the embodiment hereof illustrated in FIGS. 15 and 16, the marginal portion 18d of the blade may be formed by a series of longitudinally extending generally parallel rows of hemispherically-shaped dimples which project alternately in each row to opposite sides of the blade. Particularly, hemispherically-shaped dimple 20d projects out of the plane of the blade illustrated in FIG. 15, while the longitudinally adjacent indentation 22d projects from the opposite side of the blade. The dimples 20d alternate in each of the longitudinal rows, while adjacent longitudinal rows of dimples 20d are staggered or offset relative to one another. Consequently, portions of the margin 18d are left between adjacent dimples in each longitudinal row, as well as between adjacent longitudinal rows. Preferably, the back edge of the blade 10d, not shown, is corrugated as a result of the dimple formation, i.e., the back edge terminates along a center line through a longitudinally extending row of dimples 20d. Thus, a corrugation is obtained, affording manual purchase.

Referring now to the embodiment hereof illustrated in FIGS. 17–19, there is provided a unitarily formed blade 10e, having a marginal portion 18e and a back edge 11e. The marginal portion 18e is corrugated in a transverse direction, with each of the corrugations forming a transversely projecting elongated rib 20e and a corresponding transversely extending indentation 22e on the reverse side of the rib 20e. Consequently, the corrugations project to opposite sides of a medial plane through the blade, as illustrated in FIG. 19. Those corrugations terminate in the back edge 11e in a corrugated surface providing for manual purchase along back edge 11e. In the illustrated embodiment, the sides of each corrugation extend linearly. It will be appreciated, however, that arcuately shaped corrugations may likewise be used.

The embodiment hereof illustrated in FIGS. 20–22 is similar to the embodiment of FIGS. 17–19, except that the corrugations extend longitudinally of the blade rather than transversely. That is, the marginal portion 18f of blade 10f has longitudinally extending corrugations providing a longitudinally projecting elongated rib 20f and corresponding longitudinally extending indentation 22f on its opposite side. The back edge 11f of blade 10f has a greater angle of corrugation whereby it extends substantially normal to the plane of the blade 10f whereby a substantially flat surface is afforded along the back edge 11f to provide manual purchase. As in the previous embodiment, these longitudinal corrugations may have sides which extend linearly as illustrated or may have arcuately extending sides.

In FIGS. 23–26, there is illustrated a still further form of integral one-piece single-edge razor blade construction generally designated 10g. In this form, the marginal portion 18g of the blade is corrugated similarly as in the two preceding embodiments. However, in this form, the corrugations extend at an angle to both the longitudinal and transverse direction of the blade. As illustrated in FIG. 25, these diagonally extending corrugations are formed by elongated ribs 20g projecting to one side, while having corresponding indented ribs 22g lie along the opposite side. The back edge 11g thus terminates in a corrugated configuration, as illustrated in FIG. 24, providing for manual purchase of this form of the blade. As in the preceding two embodiments, the corrugations may be arcuately shaped rather than linearly shaped as illustrated.

Referring now to the embodiments hereof illustrated in FIGS. 27 through 32, the integral single-edge razor of the present invention may also be formed from a coiled metal strip to provide a perforated body portion 30, as well as an integral cap portion 32 formed along the edge remote from the cutting edge 34. In the form illustrated in FIGS. 27 and 29, the stock material is provided in increased width to afford an extra flap or flange 38, which can be reversely folded along a lengthwise axis to form the edge 40 opposite cutting edge 34. When reversely folded, the flap or flange 38 lies in a plane adjacent to and parallel to the plane containing the body 30 and overlies the body 30. The flap 38 terminates in an edge 42 along one side of blade 30 spaced from cutting edge 34. The foldline 40 thus affords manual purchase of the blade along the edge remote from cutting edge 34, while the flap 38 reinforces the blade.

The embodiment illustrated in FIG. 28 is similar to that shown in FIGS. 27 and 29 and is illustrated with like reference numerals applied to like parts as in FIGS. 27 and 29 followed by the suffix h. Thus, in FIG. 27, the flap or flange **38*h*, which is reversely folded at 40*h*, terminates in an edge 42*h*. In this form, however, edge 42*h* is flared outwardly away from the plane of body 30*h***. This outward flare reinforces the razor blade.

Turning now to FIG. 30, wherein like reference numerals similarly denote like parts as in FIGS. 27 and 29 followed by the suffix j, marginal portion **18*j* of the blade body 30*j* is formed to have a generally rectilinear outward projection 44 in opposition to and spaced from the flap or flange 38*j*. As in prior embodiments, flap or flange 38*j* is reversely folded at 40*j* from the body 30*j*. The spacing of projection 44 from the medial plane of the blade through body 30*j* and from flap 38*j* affords additional strength to the margin of the blade remote from the blade edge 34*j***.

Turning now to FIG. 31, blade **10*k* has a flap 38*k*, which extends in a plane parallel to body 30*k*. As in the embodiment illustrated in FIG. 30, the margin 18*k* of the body portion underlying flap or flange 38*k* is struck to project out of the plane of body 30*k*. In this form, however, the projection 44*k* extends to the upper edge 40*k* of the blade where it is reversely bent about two laterally spaced foldlines to form the flap or flange 38*k***.

In FIG. 32, the blade body **30*m* includes a flap or flange 38*m* which lies in a plane parallel to the plane containing body portion 30*m*. The margin 18*m* of the body in opposition to flap 38*m* is formed to provide a plurality of longitudinally extending, generally rectilinearly shaped, laterally spaced projections or corrugations 44*m***.

Thus, in each of the embodiments of FIGS. 27 through 32, the blade comprises a single integrated strip of metal which is formed by bending around foldlines to provide a marginal portion lying in a plane parallel to the body of the blade for reinforcing the margin of the blade remote from the cutting edge and providing manual purchase therefor. In each embodiment of the present invention, it will be appreciated that the prior two-part single-edge razor blade has been eliminated in favor of a single-edge razor formed of a single piece of material. Moreover, the costs of the materials and manufacture of the single-edge razor blade according to the present invention have been substantially reduced in comparison with the similar costs of forming a two-part conventional single-edge razor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An integral one-piece single-edge razor blade, comprising:

a thin elongated blade body having substantially uniform thickness and lying in a plane, said body having opposite, generally parallel, edges, one of said edges being sharpened to form a cutting edge; and a marginal portion of said blade body adjacent the opposite edge having a plurality of projections integral with and formed in and by said body and which project from said body out of said plane at least to one side of said body to reinforce said marginal portion, said projections being spaced one from the other longitudinally along said blade body, said marginal portion extending from said opposite blade edge toward said cutting edge a distance less than one-half the width of said blade, the remaining portion of said blade having smooth surfaces and lying in said plane, said projections being formed along said opposite edge of said blade body for facilitating manual purchase of said blade along said opposite edge.

2. A razor blade according to claim 1 wherein said projections project out of said plane to opposite sides of said body, said projections on the side of said body opposite said one body side being spaced one from the other longitudinally along said blade body.

3. A razor blade according to claim 1 wherein said projections form corrugations projecting to one side of said body.

4. A razor blade according to claim 3 wherein said corrugations are formed along said opposite edge of said blade body thereby exposing the corrugations through said opposite edge to facilitate manual purchase of said blade along said opposite edge.

5. A razor blade according to claim 4 wherein said corrugations project to opposite sides of said body, the corrugated projections on the side of said body opposite said one body side being spaced one from the other longitudinally along said blade body.

6. A razor blade according to claim 1 wherein said projections project out of said plane to opposite sides of said body, said projections comprising a plurality of discrete projections spaced longitudinally of said blade body one from the other along the opposite sides of said body.

7. A razor blade according to claim 6 wherein said projections on one side of said plane are misaligned with the projections on the opposite side of the body, the projections on each side of said body having registering recesses in said body on the opposite side of said body.

8. A razor blade according to claim 7 wherein the projections on one side of said body form indentations on the corresponding opposite side of said body.

9. A razor blade according to claim 7 wherein said projections on each side of said body are aligned in spaced generally parallel rows relative to one another in both longitudinal and transverse directions relative to said blade body.

10. A razor blade according to claim 9 wherein the rows of projections on one side of said body are offset from the rows of projections on the opposite side of said body.

11. A razor blade according to claim 7 wherein said projections have a general pyramidal shape.

12. An integral one-piece single-edge razor blade comprising a thin elongated blade body lying in a plane and having opposite, generally parallel edges, one of the edges being sharpened to form a cutting edge along said single edge; and a first portion of said blade along a long edge thereof being reversely folded out of the plane of said blade to overlie a second portion of the blade adjacent the edge of the blade opposite its cutting edge and lying in a plane parallel to the plane containing the blade to reinforce the marginal portion thereof;

said first portion comprising a flange lying to one side of the plane containing said blade, said second portion of said blade being formed to project to the opposite side of said plane whereby said flange and said second portion are spaced one from the other.

* * * * *

UNITED STATES PATENT AND TRADEMARK OFFICE

CERTIFICATE OF CORRECTION

PATENT NO. : 4,858,323

DATED : August 22, 1989

INVENTOR(S) : CLEMENS A. ITEN

It is certified that error appears in the above-identified patent and that said Letters Patent is hereby corrected as shown below:

Column 10, line 2 after "blade" insert --body--.
line 6 after "blade" insert --body--;
line 8 after "blade" insert --body--.

Signed and Sealed this

Twenty-ninth Day of December, 1992

*Attest:*

DOUGLAS B. COMER

*Attesting Officer*

*Acting Commissioner of Patents and Trademarks*